US008720428B2

(12) United States Patent
Jantzen

(10) Patent No.: US 8,720,428 B2
(45) Date of Patent: May 13, 2014

(54) ARROW MOUNTED BLIND OR DECOY

(76) Inventor: James Jantzen, Del Norte, CO (US)

( * ) Notice: Subject to any disclaimer, the term of this patent is extended or adjusted under 35 U.S.C. 154(b) by 113 days.

(21) Appl. No.: 13/566,968

(22) Filed: Aug. 3, 2012

(65) Prior Publication Data

US 2013/0255737 A1 Oct. 3, 2013

Related U.S. Application Data

(60) Provisional application No. 61/618,751, filed on Mar. 31, 2012.

(51) Int. Cl.
*F41B 5/00* (2006.01)

(52) U.S. Cl.
USPC ..... 124/86

(58) Field of Classification Search
USPC ..... 124/23.1, 25.5, 25.6, 25.7, 86, 88; 224/916; 473/578
See application file for complete search history.

(56) References Cited

U.S. PATENT DOCUMENTS 3,179,102 A 4/1965 Peckham
4,817,579 A 4/1989 Mathias
4,876,817 A 10/1989 Hill
4,974,575 A 12/1990 Mitchell
5,127,180 A 7/1992 Norton et al.
5,641,013 A 6/1997 Wingfield
5,944,041 A 8/1999 Kitchens
6,431,192 B2 8/2002 O'Hare
6,712,058 B2 3/2004 Porter
7,275,532 B2 10/2007 Niemackl et al.
7,770,573 B2 8/2010 Haugen
7,958,878 B2 6/2011 Hoffmann

*Primary Examiner* — John Ricci
(74) *Attorney, Agent, or Firm* — Stanley J. Gradisar; Sheridan Ross PC

(57) ABSTRACT

An arrow mounted blind or decoy offers portability, flexibility, and minimum weight while always being mounted to a bow. The arrow mounted blind or decoy can be quickly deployed and easily folded against the arrow to which it is affixed and stowed out of the way. A mount is attached to an arrow with clamp screws. Spars are attached to the mount with an internal shock cord that runs through the mount. Fabric having camouflage properties and various colors is attached to the spars. In a deployed position, a view hole in the fabric allows an arrow to be drawn in the bow and through the view hole, allowing the hunter to see through to observe game while concealing the hunter from the game. The internal shock cord will stretch allowing the spars to be removed from the mount and folded over and attached to the arrow with a clamp.

22 Claims, 4 Drawing Sheets

ARROW MOUNTED BLIND OR DECOY

CROSS-REFERENCES TO RELATED APPLICATIONS

This application claims the benefit of U.S. Provisional Application Ser. No. 61/618,751 filed on Mar. 31, 2012 and titled "Arrow Mounted Blind Or Decoy" which is incorporated herein by reference in its entirety for all that is taught and disclosed therein.

BACKGROUND

This disclosure relates generally to bow hunting and more specifically to camouflage cover for bow hunters and the like.

SUMMARY

This summary is provided to introduce in a simplified form a selection of concepts that are further described below in the detailed description. This summary is not intended to identify key features or essential features of the claimed subject matter, nor is it intended to be used to limit the scope of the claimed subject matter.

The detailed description below describes an arrow mounted blind or decoy that offers portability, flexibility, and minimum weight while always being mounted to a bow. The arrow mounted blind or decoy can be quickly deployed and easily folded against the arrow to which it is affixed and stowed out of the way in a quiver when not needed. A mount is attached to an arrow with clamp screws. Spars are attached to the mount with an internal shock cord that runs through the mount. Fabric having camouflage properties is attached to the spars. In a deployed position, a hole in the fabric allows the hunter to see through to observe game while concealing the hunter from the game. When the spars are folded the internal shock cord will stretch allowing the spars to be folded over and attached to the arrow with a spar clamp.

DETAILED DESCRIPTION

Figure 1:
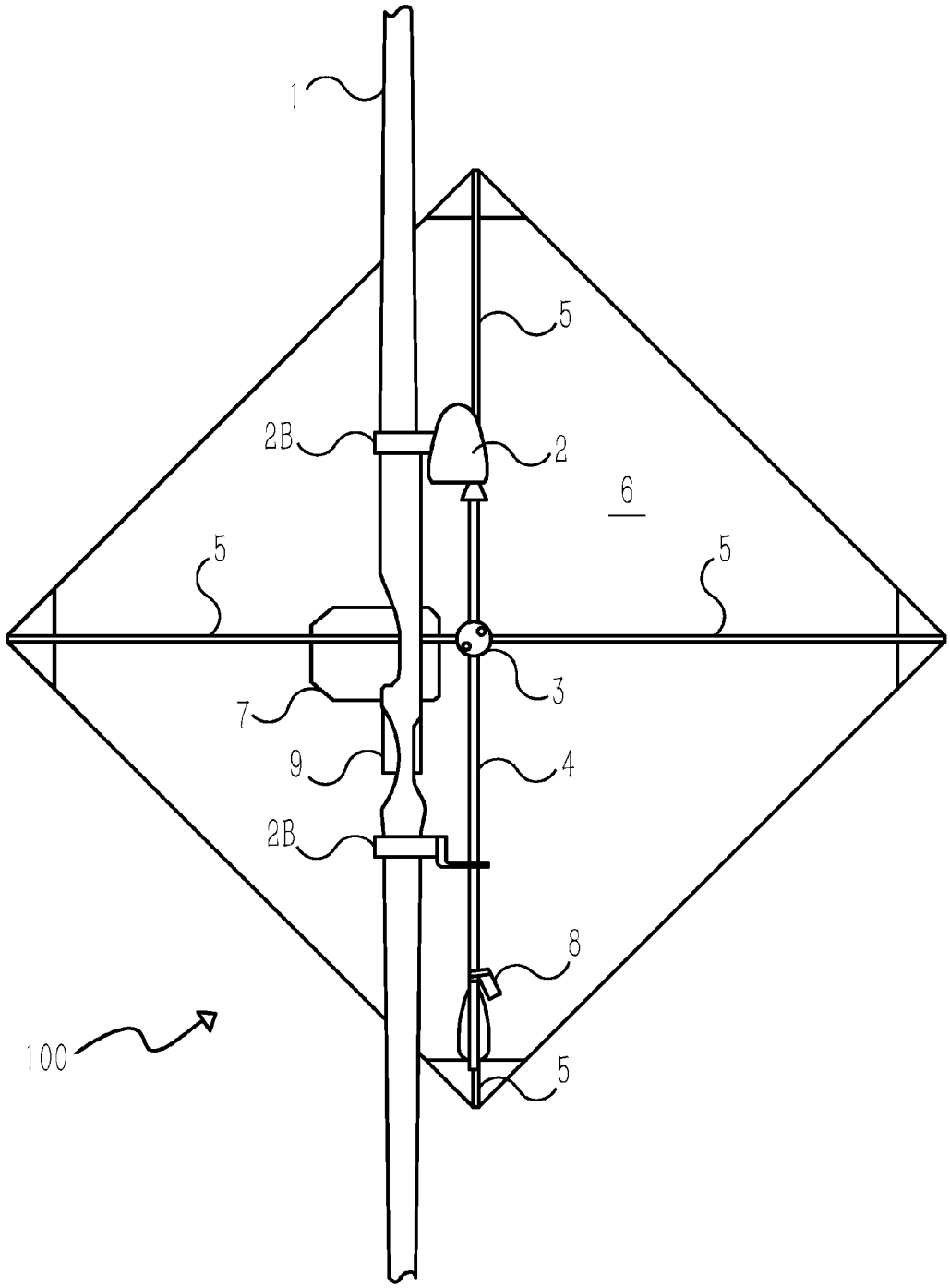
FIG. 1 shows an elevation view of an embodiment of an arrow mounted blind or decoy in a deployed position of the present invention.

Referring now to the Figures, in which like reference numerals refer to structurally and/or functionally similar elements thereof, FIG. 1 shows an elevation view of an embodiment of an arrow mounted blind or decoy in a deployed position of the present invention. Referring now to FIG. 1, Arrow Mounted Blind Or Decoy 100 has the benefit of being light in weight and can be quickly mounted to Quiver 2 of Bow 1. Quiver 2 has two Mounting Brackets 2B to mount Quiver 2 to Bow 1. Thus, Arrow Mounted Blind Or Decoy 100 can be quickly deployed but also folded against Arrow 4 to which it is affixed and stowed out of the way in the bow-mounted Quiver 2. Arrow 4 of Arrow Mounted Blind Or Decoy 100 is typically stowed in the leading slot of Quiver 2 so that when it is deployed it will clear the front of Bow 1, offering concealment to the hunter, and allow easy access to the other arrows stowed in Quiver 2.

Mount 3 is attached to Arrow 4 with Clamp Screws 3A. In one embodiment Arrow 4 is a rod similar in length and diameter to an arrow. Channel 4A (see FIG. 2B) receives Arrow 4 between the two halves of Mount 3. When Clamp Screws 3A are tightened, the two halves of Mount 3 act like a clamp on Arrow 4. Mount 3 may be made of aluminum or any other suitable material. Fabric 6 is attached to Spars 5 which are hollow tubes or rods and may be made of carbon fiber or any other suitable material. Fabric 6 may have a variety of camouflage patterns and a variety of colors to match the terrain where used. Fabric 6 may be made of silk or any other appropriate material. Fabric 6 may also have reinforced corners that receive the ends of Spars 5. View Hole 7 located somewhat centrally in Fabric 6 allows the bow hunter to see through Fabric 6 and shoot at game. Thus, Mount 3 is attached to Arrow 4 with Clamp Screws 3A so that View Hole 7 is aligned to receive an arrow when drawn with Bow 1. Finger Tab 9 is attached to Fabric 6 so the hunter can place a finger through Finger Tab 9 while holding Bow 1 to hold Fabric 6 to Bow 1 in a way to minimize movement of Fabric 6. Quiver 2 is mounted to Bow 1 in any of several standard ways known by one skilled in the art. Arrow Mounted Blind Or Decoy 100 is stored folded in Quiver 2 (see FIG. 3) until needed. Mount 3 will universally mount to any standard arrow or an appropriately sized rod.

Figure 2A:
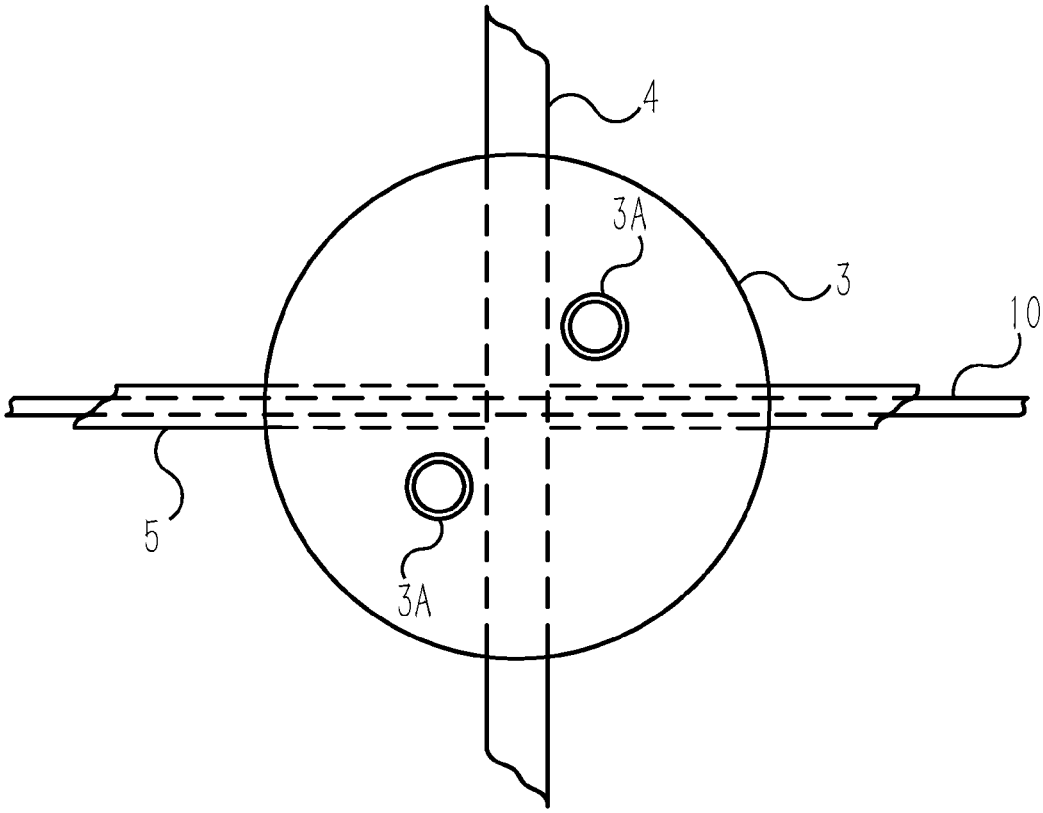
FIGS. 2A, 2B, and 2C show a front view, a top view, and a side view of the mount detail of an embodiment of an arrow mounted blind or decoy of the present invention.
Figure 2B:
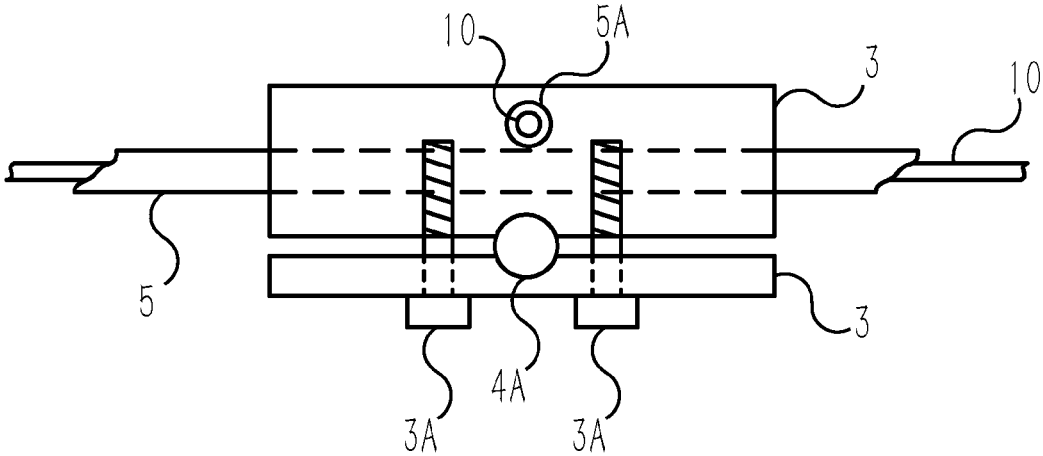
Figure 2C:
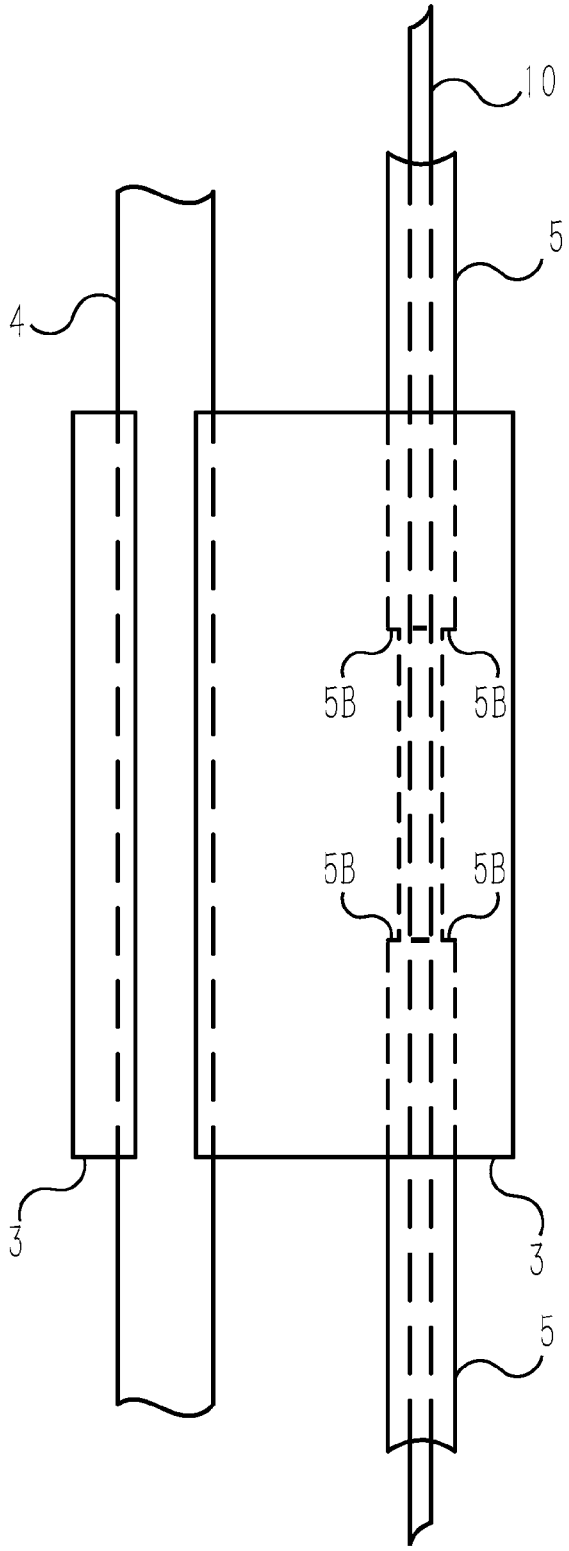

FIG. 2A shows a front view, FIG. 2B shows a top view, and FIG. 2C shows a side view of the mount detail of an embodiment of an arrow mounted blind or decoy of the present invention. Referring now to FIGS. 2A, 2B, and 2C, Spars 5 from the folded position are inserted into Mount 3 with Internal Shock Cord 10 running through Spars 5 and Mount 3. Internal Shock Cord 10 may be made of nylon elastic rope or any other suitable material. Mount 3 has Spar Holes 5A that are drilled or bored through Mount 3 letting Internal Shock Cord 10 run from one end of Spars 5 through Mount 3 to the other end of the opposing Spars 5. Spar Holes 5A are drilled or bored in Mount 3 in such a way that there are Shoulders 5B inside Mount 3 so Spars 5 can only enter about one-third of the way to less than one-half way into Mount 3. Spar Holes 5A are slightly larger than Spars 5 for easy removal, but allowing for a firm fit of Spars 5 in Spar Holes 5A. Spar Holes 5A through Mount 3 are big enough to allow Internal Shock Cord 10 easy movement so it can stretch allowing Spars 5 to be removed, folded, and stored.

Figure 3:
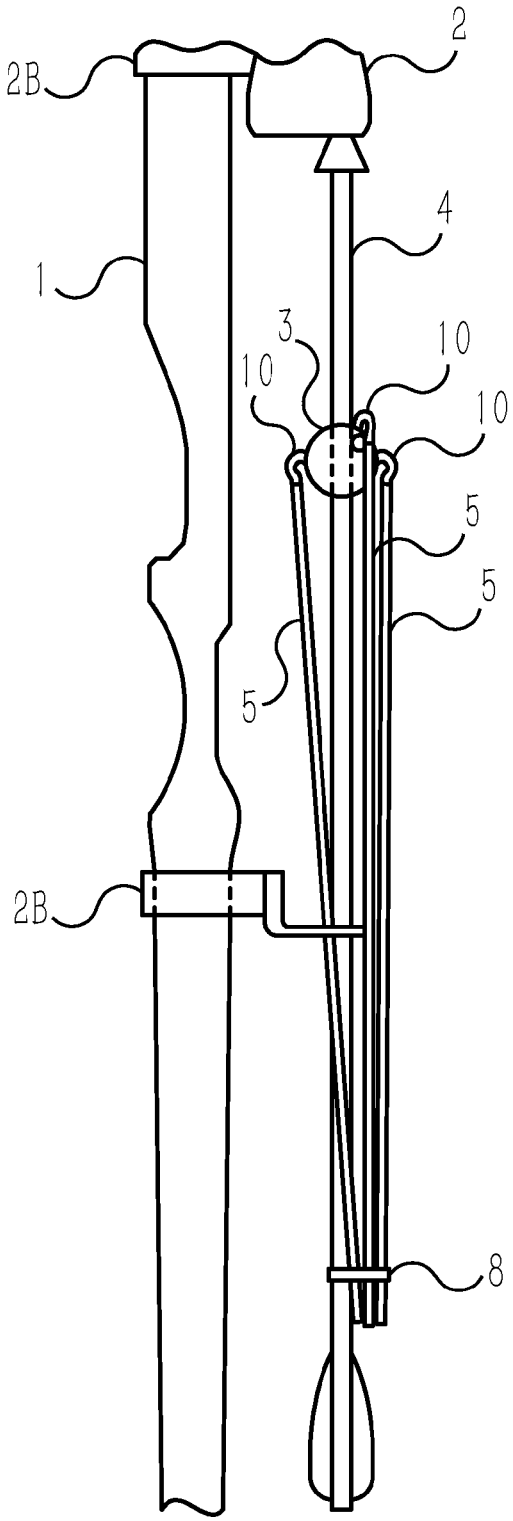
FIG. 3 shows an elevation view of an embodiment of an arrow mounted blind or decoy in a folded position of the present invention.

FIG. 3 shows an elevation view of an embodiment of an arrow mounted blind or decoy in a folded position of the present invention. Referring now to FIG. 3, when Spars 5 are folded Internal Shock Cord 10 will stretch allowing Spars 5 to be folded over and attached to Arrow 4 with Spar Clamp 8. (Fabric 6 is not shown in FIG. 3 for clarity. Fabric 6 will fold and buckle similar to the fabric of a folded umbrella, or, Fabric 6 may be removed from Spars 5 and folded up and stored by the hunter when not needed.) A first Internal Shock Cord 10 is attached at a first end to an outer end of a first Spar 5, runs through Mount 3, and is attached at a second end to an outer end of a second Spar 5. A second Internal Shock Cord 10 is attached at a first end to an outer end of a third Spar 5, runs through Mount 3, and is attached at a second end to an outer end of a fourth Spar 5. The first and second Spars 5 with the first Internal Shock Cord 10, and the third and fourth Spars 5 with the second Internal Shock Cord 10 may be aligned straight, or at 90° to each other, when unfolded or deployed. The tension provided by Internal Shock Cords 10 will keep the inner ends of each Spar 5 seated in Mount 3 up to Shoulders 5B. Only one Internal Shock Cord 10 could be used by doubling back on itself through the Spars 5 provided that the internal diameter of Spars 5 and the Spar Holes 5A can accommodate two lengths of Internal Shock Cord 10 there through without restricting the stretching and contracting of Internal Shock Cord 10. Fabric 6 is attached at each corner to an outer end of each of the four Spars 5 and is sized to allow for a taught fit when in the unfolded or deployed position.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. It will be understood by those skilled in the art that many changes in construction and widely differing embodiments and applications will suggest themselves without departing from the scope of the disclosed subject matter.

What is claimed is:

1. An apparatus for concealment comprising:
a bow;
a quiver mounted to the bow;
a rod stowed in the quiver;
a mount adapted to be attached to the rod;
a plurality of spars inserted into the mount to secure a deployed position of the apparatus;
at least one internal shock cord for securing the plurality of spars to the mount in the deployed position, the at least one internal shock cord running internally through the plurality of spars and internally through the mount; and
a fabric attached to the outer ends of the plurality of spars, wherein the fabric of the apparatus in the deployed position provides concealment.

2. The apparatus according to claim 1 wherein the rod is an arrow.

3. The apparatus according to claim 1 wherein the fabric further comprises:
a camouflage pattern; and
at least one color.

4. The apparatus according to claim 1 wherein the plurality of spars further comprise:
a first spar;
a second spar;
a third spar; and
a fourth spar;
wherein each spar has an outer end and an inner end, and further wherein each inner end is inserted into the mount in the deployed position.

5. The apparatus according to claim 4 further comprising:
a spar clamp, wherein in a folded position of the apparatus, the inner ends of the plurality of spars are removed from the mount and the outer ends of the plurality of spars are folded and secured to each other and to the rod with the spar clamp.

6. The apparatus according to claim 1 wherein the apparatus in the deployed position extends in front of the bow.

7. The apparatus according to claim 1 wherein the mount further comprises:
a first half;
a second half;
a channel between the first half and the second half; and
at least one clamp screw, wherein the rod is received in the channel and secured between the first half and the second half of the mount by tightening the at least one clamp screw.

8. The apparatus according to claim 1 further comprising:
a plurality of spar holes through the mount, each of the plurality of spar holes having a first diameter internal to the mount smaller than a second diameter that exits the mount, wherein in the deployed position of the apparatus each of the plurality of spars has an end inserted into one of the plurality of spar holes through the second diameter and stop at a shoulder formed by the first diameter of the plurality of spar holes.

9. The apparatus according to claim 8 wherein the plurality of spars further comprise:
an outer end of a first spar, having attached thereto a first end of the at least one internal shock cord, the at least one internal shock cord passing through the length of the first spar;
an inner end of the first spar received in a one of the plurality of spar holes in the mount, the at least one internal shock cord passing out of the inner end of the first spar and through the mount;
an inner end of a next spar received in a one of the plurality of spar holes in the mount, the at least one internal shock cord passing through the inner end of the next spar and through the length of the next spar;
an outer end of the next spar; and
a second end of the at least one internal shock cord attached to the outer end of the next spar;
wherein tension provided by the at least one internal shock cord secures the first and next spars in the mount in the deployed position of the apparatus.

10. The apparatus according to claim 1 wherein the fabric further comprises:
a view hole located somewhat centrally in the fabric allowing visibility through the view hole and allowing an arrow to be drawn in the bow and through the view hole.

11. The apparatus according to claim 1 wherein the fabric further comprises:
a finger tab located in the fabric adapted to receive a finger of a hand holding the bow to minimize movement of the fabric when the apparatus is in the deployed position.

12. A method for concealment using an apparatus, the method comprising the steps of:
(a) mounting a quiver to a bow;
(b) stowing a rod in the quiver;
(c) attaching a mount to the rod;
(d) inserting a plurality of spars into the mount, securing a deployed position of the apparatus;
(e) securing the plurality of spars to the mount with at least one internal shock cord that runs internally through the plurality of spars and internally through the mount; and
(f) attaching a fabric to the outer ends of the plurality of spars, wherein the fabric of the apparatus in the deployed position provides concealment.

13. The method according to claim 12 further comprising the step of:
mounting an arrow to the quiver instead of a rod.

14. The method according to claim 12 further comprising the step of:
fashioning a camouflage pattern to the fabric, the camouflage pattern having at least one color.

15. The method according to claim 12 wherein step (d) further comprises the steps of:
inserting an inner end of a first spar into the mount;
inserting an inner end of a second spar into the mount;
inserting an inner end of a third spar into the mount; and
inserting an inner end of a fourth spar into the mount, securing the deployed position of the apparatus.

16. The method according to claim 15 further comprising the steps of:

removing the inner ends of the plurality of spars from the mount;

folding the plurality of spars together; and clamping with a spar clamp the outer ends of the plurality of spars to the rod.

17. The method according to claim 12 further comprising the step of:

extending the apparatus in the deployed position in front of the bow.

18. The method according to claim 12 wherein step (c) further comprises the steps of:

boring a channel between a first half and a second half of the mount;

receiving the rod in the channel between the first half and a second half of the mount; and tightening at least one clamp screw to secure the rod in the channel between the first half and the second half of the mount.

19. The method according to claim 12 further comprising the steps of:

boring a plurality of spar holes through the mount, each of the plurality of spar holes having a first diameter internal to the mount smaller than a second diameter that exits the mount;

inserting each of the plurality of spars into a one of the plurality of spar holes having the second diameter exiting the mount; and stopping the insertion of each of the plurality of spars into a one of the plurality of spar holes at a shoulder formed by the first diameter, securing the apparatus in the deployed position.

20. The method according to claim 19 further comprising the steps of:

attaching a first end of the at least one internal shock cord to an outer end of a first spar;

passing the at least one internal shock cord through the length of the first spar;

passing the at least one internal shock cord through an inner end of the first spar received in a one of the plurality of spar holes in the mount;

passing the at least one internal shock cord through the mount;

passing the at least one internal shock cord through an inner end of a next spar received in a one of the plurality of spar holes in the mount;

passing the at least one internal shock cord through the length of the next spar; and attaching a second end of the at least one internal shock cord to an outer end of the next spar;

wherein tension provided by the at least one internal shock cord secures the first and next spars in the mount in the deployed position of the apparatus.

21. The method according to claim 12 further comprising the step of:

locating a view hole somewhat centrally in the fabric allowing visibility through the view hole and allowing an arrow to be drawn in the bow and through the view hole.

22. The method according to claim 12 further comprising the steps of:

locating a finger tab in the fabric; and receiving a finger of a hand holding the bow in the finger tab to minimize movement of the fabric when the apparatus is in the deployed position.

* * * * *